United States Patent [19]

Amortegui

[11] 4,284,986

[45] Aug. 18, 1981

[54] SHIRT-POCKET MEDICAL ALERT DEVICE

[76] Inventor: Carlos Amortegui, 1116 Wilmington St., Opa Locka, Fla. 33054

[21] Appl. No.: 162,009

[22] Filed: Jun. 23, 1980

[51] Int. Cl.[3] ..... G08B 21/00

[52] U.S. Cl. ..... 340/573; 128/782

[58] Field of Search ..... 340/571, 573, 575, 568, 340/689; 128/782

[56] References Cited

U.S. PATENT DOCUMENTS

| | | | |
|---|---|---|---|
| 3,248,723 | 4/1966 | Miethe | 340/689 |
| 3,614,763 | 10/1971 | Yannuzzi | 340/689 |

*Primary Examiner*—Alvin H. Waring

*Attorney, Agent, or Firm*—John Cyril Malloy

[57] ABSTRACT

A shirt-pocket medical alert device having a housing with a receptacle including an alarm connected to a tilt actuated circuit including a power source wherein a flowable substance in the circuit activates the alarm when the circuit is moved out of a normal orientation position.

10 Claims, 4 Drawing Figures

SHIRT-POCKET MEDICAL ALERT DEVICE

BACKGROUND OF THE INVENTION

TECHNICAL FIELD

This invention relates generally to alarm devices and, more particularly, to medical alert devices.

For sometime now older people and others particularly concerned with their medical condition, particularly in the case of pulminary decease and the like, have been concerned that upon a heart attack or the like where they would be incapacitated they would be unable to notify anyone or call for help. As is well known, the sooner help arrives the better one's chances for survival in such a medical emergency.

Applicant has deviced a device wherein one walking down the street, for instance, and suffering a heart attack and falling down would involuntarily and automatically alert others to his medical problem through a tilt actuated circuit connected to an alarm.

The device is sized and shaped to fit comfortably in one's shirt-pocket and not to be activated until such time as the user would fall down or otherwise become physically incapacitated.

SUMMARY OF THE INVENTION

A tilt actuated circuit comprising a mercury switch connected to a portable power source and an alarm or noise-making device is positioned in a first normal orientation in the unsounding or silent position. When the user suffers a heart attack and falls over, a second orientation is achieved and the alarm goes off warning others of the user's medical emergency.

In accordance with these and other objects which have become apparent hereinafter, the instant invention will now be described with reference to the accompanying drawings in which:

DESCRIPTION OF THE PREFERRED EMBODIMENT

Figure 1:
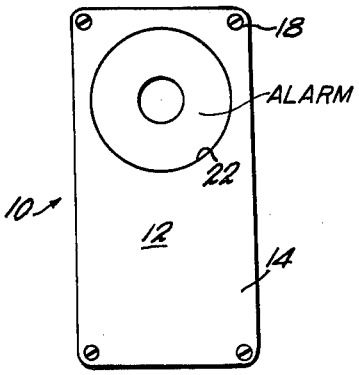
FIG. 1 is a front elevation view of the instant invention.
Figure 2:
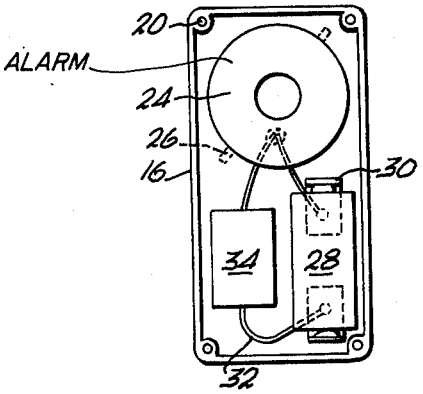
FIG. 2 is an elevation view similar to FIG. 1 with the cover having been removed and showing the interior structure of the device.

Referring more particularly to the drawings wherein like reference characters designate like or corresponding parts and referring paticularly to FIG. 1, there is shown the invention 10 and a shirt-pocket size medical alert device comprising a housing 12 having a cover 14 and a receptacle, as shown in FIG. 2, 16, The cover is connected to the receptacle by conventional means such as screw and thread means 18 and 20 shown in FIGS. 1 and 2. The housing cover 14 is provided with a window 22 wherein the alarm 24 is visible. The alarm is connected to the receptacle 16 through biasing means 26. although it will be appreciated that other conventional connection means may be used within the scope of the invention. A battery 28 is held to the receptacle 16 by holding means 30. Of course other power source means may be used within the scope of the invention but it has been found that a battery or similar portable power source means is preferable. The battery is connected by electrical conduit means 32 to the bell or alarm 24 and a tilt actuated switch 34.

Figure 3:
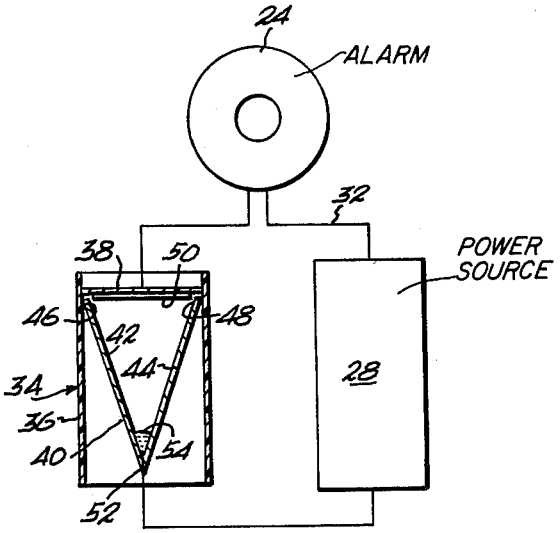
FIG. 3 is a circuit diagram when the device is oriented as shown in FIG. 1 an FIG. 2.

Applicant uses a tilt actuated switch shown in FIG. 3 in schematic connection with the power source 28 and alarm 24.

The tilt actuated switch, shown in FIG. 3, generally denoted by the numeral 34, comprises a cylinder carrier 36 spanned by an electrically conductive plate 38 and including a second conductor 40 which may be of a cone-shape and have electrically conductive side walls such as at 42 and 44. The side walls 42 and 44 include leading edges 46 and 48 contacting the carrier and spaced a predetermined distance from the plate.

An insulator 50 of predetermined thickness is connected to the plate as shown in FIG. 3 and spaced a predetermined distance between the plate and cone.

Figure 4:
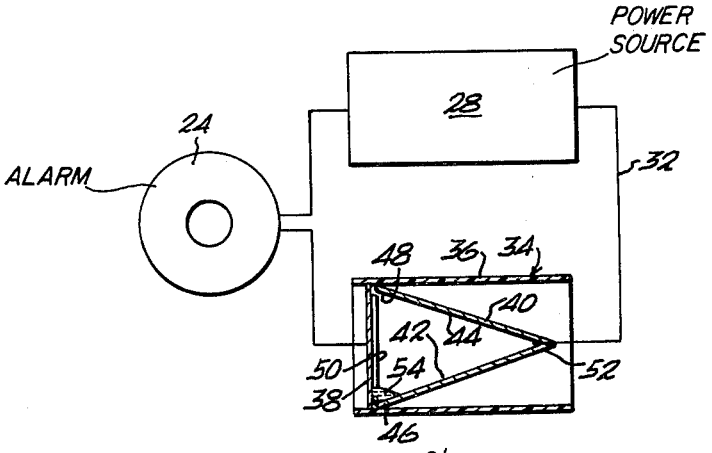
FIG. 4 is the same circuit diagram but illustrating the switch mechanism to be described in an on position.

The cone includes a bottom portion defining a tip 52 wherein an electrically conductive flowable substance, 54, is captured in the tip as shown. The flowable substance is of a predetermined thickness or diameter such that when the circuit is tilted, the flowable liquid flows down a side of the cone, such as 42, and contacts the plate 38 over the insulator 50 as shown in FIG. 4.

When the plate is tilted and the tilt actuated switch is moved from its original position of orientation such as in FIG. 2 or FIG. 3, the electrically conductive flowable substance 54 slides down side wall 42 and completes the circuit between the cone 40 and plate 38 past insulator 50. In the situation schematically represented in FIG. 4, the electrical circuit is completed and thus the alarm 24 sounds communicating a message to help to a passerby or the like.

In use, a user moving in the position of first orientation shown in FIG. 2 and schematically represented in FIG. 3 walks in the erect position with the flowable substance, such as mercury, situated at the tip 52 of the second electrical conductor 40. If the user should fall from a heart attack or otherwise achieve a prone position, the electrically conductive flowable substance moves down a side wall of the second cone conductor and the flowable substance spans the distance between the first and second conductors 38 and 40, respectively, completing electrical contact and sounding the alarm.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A shirt-pocket sized medical alert device comprising:

a separable housing sized and shaped to be carried unobtrusively by a user in a shirt pocket, for example, and to have an original, predetermined orientation on the user, the housing including a cover and a receptacle, a tilt activated alarm within the receptacle comprising:

alarm means, power source means, tilt actuated circuit means, and electrically conductive conduit means connecting the alarm, power and tilt activated switch means, defining a tilt actuated circuit, whereby the alarm means is activated when the circuit is tilted and moved sufficiently from its original, predetermined position, for example when the user falls upon suffering a heart attack;

said tilt activated switch means comprising:

a cylindrical carrier spanned by an electrically conductive plate defining a first conductor and including a cone-shaped second conductor having a leading edge contacting the carrier and spaced a predetermined distance from the plate, a bottom end defining a tip and diverging electrically conductive side walls between the tip and leading edge, an insulator of predetermined thickness between the plate and the cone, and an electrically conductive flowable substance held in the cone tip when the housing is in the original predetermined orientation, the flowable substance of predetermined thickness sufficient to span the distance between the plate and the cone leading edge.

2. The device as set forth in claim 1 wherein the tilt activated switch means comprises:

a cylindrical carrier spanned by an electrically conductive plate defining a first conductor and including a cone-shaped second conductor having a leading edge contacting the carrier and spaced a predetermined distance from the plate, a bottom end defining a tip and diverging electrically conductive side walls between the tip and leading edge, an insulator of predetermined thickness between the plate and the cone, and an electrically conductive flowable substance held in the cone tip when the housing is in the original predetermined orientation, the flowable substance of predetermined thickness sufficient to span the distance between the plate and the cone leading edge.

3. The device as set forth in claim 1 wherein the tilt activated switch is a mercury switch and the flowable substance is mercury.

4. The device as set forth in claim 1 or claim 3 wherein the carrier is a cylinder and has electrically conductive side walls.

5. The device as set forth in claim 1 wherein the power source means comprises a battery.

6. The device as set forth in claim 1 wherein the alarm means is fastened to the receptacle by biased nesting means.

7. The device as set forth in claim 1 wherein the housing is made from an unbreakable lightweight plastic.

8. The device as set forth in claim 1 wherein the plate is made of an electrically conductive metal.

9. The device as set forth in claim 1 wherein the cone is made of metal.

10. The device as set forth in claim 2 wherein the insulator is made from plastic.

* * * * *